US010114339B2

(12) United States Patent
Merino

(10) Patent No.: US 10,114,339 B2
(45) Date of Patent: Oct. 30, 2018

(54) ANTI-SHOCK SYSTEM WITH ANGULAR LOCKING

(71) Applicant: ETA SA Manufacture Horlogere Suisse, Grenchen (CH)

(72) Inventor: Antonio Merino, Moutier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/450,263

(22) Filed: Mar. 6, 2017

(65) Prior Publication Data

US 2017/0261937 A1 Sep. 14, 2017

(30) Foreign Application Priority Data

Mar. 14, 2016 (EP) ..... 16160124

(51) Int. Cl.
*G04B 37/05* (2006.01)
*G04B 31/04* (2006.01)

(52) U.S. Cl.
CPC ..... *G04B 37/052* (2013.01); *G04B 31/04* (2013.01)

(58) Field of Classification Search
CPC ..... G04B 31/04; G04B 37/052
See application file for complete search history.

(56) References Cited

U.S. PATENT DOCUMENTS

| | | | | |
|---|---|---|---|---|
| 2,239,682 | A | 4/1941 | Marti | |
| 2006/0187767 | A1* | 8/2006 | Conus | G04B 31/04 368/324 |
| 2006/0215499 | A1* | 9/2006 | Kohler | G04B 31/04 368/324 |
| 2012/0155231 | A1* | 6/2012 | Conus | G04B 31/04 368/324 |

FOREIGN PATENT DOCUMENTS

| | | |
|---|---|---|
| CH | 330904 | 6/1958 |
| FR | 1 008 173 | 5/1952 |

OTHER PUBLICATIONS

European Search Report dated Oct. 17, 2016 in European Application 16160124, filed on Mar. 14, 2016 ( with English translation of Categories of Cited Documents).

* cited by examiner

*Primary Examiner* — Edwin A. Leon
*Assistant Examiner* — Jason Collins
(74) *Attorney, Agent, or Firm* — Oblon, McClelland, Maier & Neustadt, L.L.P.

(57) ABSTRACT

A shock absorber device for an arbor of a timepiece element includes a support including a base cup surmounted by a peripheral rim delimited, opposite the cup, by an upper surface and including an outer wall, the cup and the rim defining together a housing. The shock absorber device further includes a pivot module extending along an axis, the pivot module being arranged inside the housing and being able to cooperate with the arbor. The shock absorber device further includes fastening device including a peripheral shoulder extending from the rim towards the axial center of the cup, and elastic device being arranged between the pivot module and the shoulder to exert a stress on the pivot module.

8 Claims, 4 Drawing Sheets

C

ANTI-SHOCK SYSTEM WITH ANGULAR LOCKING

This application claims priority from European Patent Application No 16160124.0 of Mar. 14, 2016, the entire disclosure of which is hereby incorporated herein by reference.

The present invention concerns an anti-shock system for an arbor of a timepiece wheel set. The arbor comprises a pivot-shank including a support, said support being provided with a housing for receiving a pivot system into which the pivot-shank is inserted. The anti-shock system further includes elastic means arranged to exert at least an axial force on said pivot system.

The technical field of the invention is the technical field of fine mechanics.

BACKGROUND OF THE INVENTION

The present invention concerns bearings for timepieces and more specifically of the shock absorber type. Designers of mechanical watches have, for a long time, devised numerous devices enabling an arbor to absorb the energy resulting from a shock, particularly a lateral shock, by bearing against a wall of the hole in the base block through which the arbor passes, while allowing a temporary movement of the pivot-shank before it is returned to its rest position under the action of a spring.

FIGS. 1 and 2 illustrate a device, called a double inverted cone device, which is currently used in timepieces found on the market.

A support 1, the base of which comprises a hole 2 for the passage of the balance staff 3 ending in a pivot-shank 3*a*, allows positioning of a setting 20, in which are fixed a jewel hole 4, traversed by pivot-shank 3*a*, and an endstone 5. Setting 20 is held inside a housing 6 of support 1 by a spring 10 which, in this example, includes radial extensions 9 compressing endstone 5. Support 1 is a rotationally symmetrical part including a circular rim 11. This rim 11 is interrupted at two diametrically opposite places by an aperture 12 so as to create two semi-circular rims 11*a*, 11*b*. Aperture 12 is arranged partly in the two semi-circular rims 11*a*, 11*b* so as to form two return portions. Setting 20 is held inside a housing 6 of support 1 by elastic means such as a spring 10 which, in this example, includes radial extensions 9 compressing endstone 5. Spring 10 is of the axial type and is lyre-shaped so as to rest on the return portions of semi-circular rims 11*a*, 11*b*. Recess 6 includes two shoulders 7, 7*a* in the form of inverted cones on which complementary shoulders 8, 8*a* of setting 20 rest. Said shoulders must be made with a high level of precision. In the event of an axial shock, jewel hole 4, endstone 5 and the balance staff move and spring 10 acts alone to return balance staff 3 to its initial position. Spring 10 is sized to have a limited displacement such that, beyond the limit, balance staff 3 comes into contact with stop members 14 allowing staff 3 to absorb the shock, which pivot-shanks 3*a* of staff 3 cannot do without breaking. In the event of a lateral shock, i.e. when the end of the pivot-shank upsets setting 20 moving it out of its resting plane, spring 10 cooperates with the complementary inclined planes 7, 7*a*; 8, 8*a* to recentre setting 20. These bearings have been sold, for example, under the trademark Incabloc®. These springs may be made of phynox or brass and are manufactured by conventional cutting means.

One drawback of these shock absorber systems is that they are not easy to mount. Indeed, some parts like support 1 and spring 10 must be oriented and manipulated in a certain manner during the mounting operation to enable assembly to occur. Thus, the assembly of the shock absorber system starts by taking a support and then a setting with its jewels. The setting is placed inside the housing in the support. Next, a lyre-shaped axial spring is taken. This is manipulated so that it can rest underneath the return portions of semi-circular rims 11*a*, 11*b* of the support.

SUMMARY OF THE INVENTION

It is an object of the invention to overcome the drawbacks of the prior art by proposing to provide a shock absorber system whose assembly process is simple, secure and can be automated.

To this end, the invention concerns a shock absorber device for an arbor of a timepiece element including a support comprising a base cup surmounted by a peripheral rim which is delimited, opposite said cup, by an upper surface and including an outer wall, said cup and said rim defining together a housing, the device further including at least one pivot module extending along an axis, said at least one pivot module being arranged inside said housing and able to cooperate with said arbor, said device comprising fastening means including a peripheral shoulder extending from the rim towards the axial centre of the cup, elastic means being arranged between the pivot module and the shoulder to exert a stress on the pivot module, characterized in that the elastic means include a spring ring provided with at least one radial extension extending towards the centre of said ring and with at least two catches extending in an opposite direction, said shoulder including at least one notch to allow the bayonet assembly of said spring ring and in that the shoulder includes, on either side of said at least one notch, a beak oriented towards the base cup allowing said elastic means to be locked in rotation.

In a first advantageous embodiment, the shoulder includes three notches, said spring ring including three catches.

In a second advantageous embodiment, said elastic means include a spring ring comprising at least two arms extending towards the axial centre of said spring ring to press said pivot module into the housing in the support.

In a third advantageous embodiment, the at least two arms are diametrically opposite.

In another advantageous embodiment, the spring ring includes three angularly distributed elastic arms.

In another advantageous embodiment, said means include a spring ring including inner radial extensions disposed between annular portions, said inner radial extensions consisting of the band forming the ring bent towards the interior of the ring.

In another advantageous embodiment, said inner radial extensions are regularly distributed.

In another advantageous embodiment, the spring ring includes three inner radial extensions.

BRIEF DESCRIPTION OF THE DRAWINGS

The objects, advantages and features of the anti-shock system or shock absorber device according to the present invention will appear more clearly in the following detailed description of at least one embodiment of the invention given simply by way of non-limiting example and illustrated by the annexed drawings, in which.

DETAILED DESCRIPTION

The present invention proceeds from the general inventive idea which consists in providing a simple, easy-to-assemble anti-shock or shock absorber device, offering fewer risks of problems during assembly. This shock absorber system is arranged to be mounted on a main plate and/or at least one bar of a timepiece movement. The timepiece movement is placed inside a timepiece including a middle part closed by a back cover and a crystal.

Figure 1:
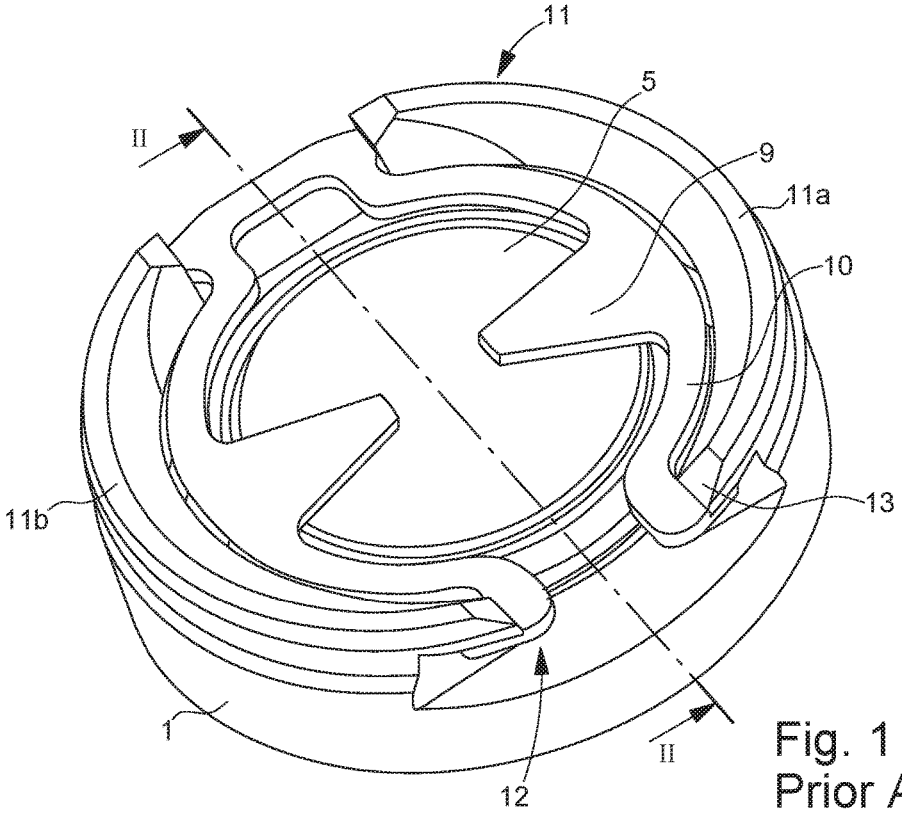
Fig. 1 Prior Art
FIGS. 1 and 2, already cited, represent schematic views of a shock absorber system for a timepiece according to the prior art.
Figure 2:
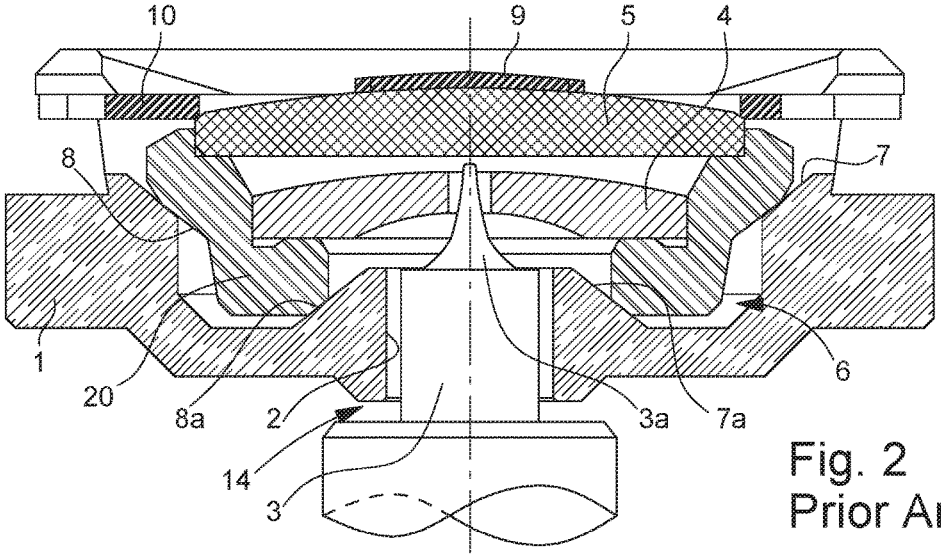
Fig. 2 Prior Art
Figure 3:
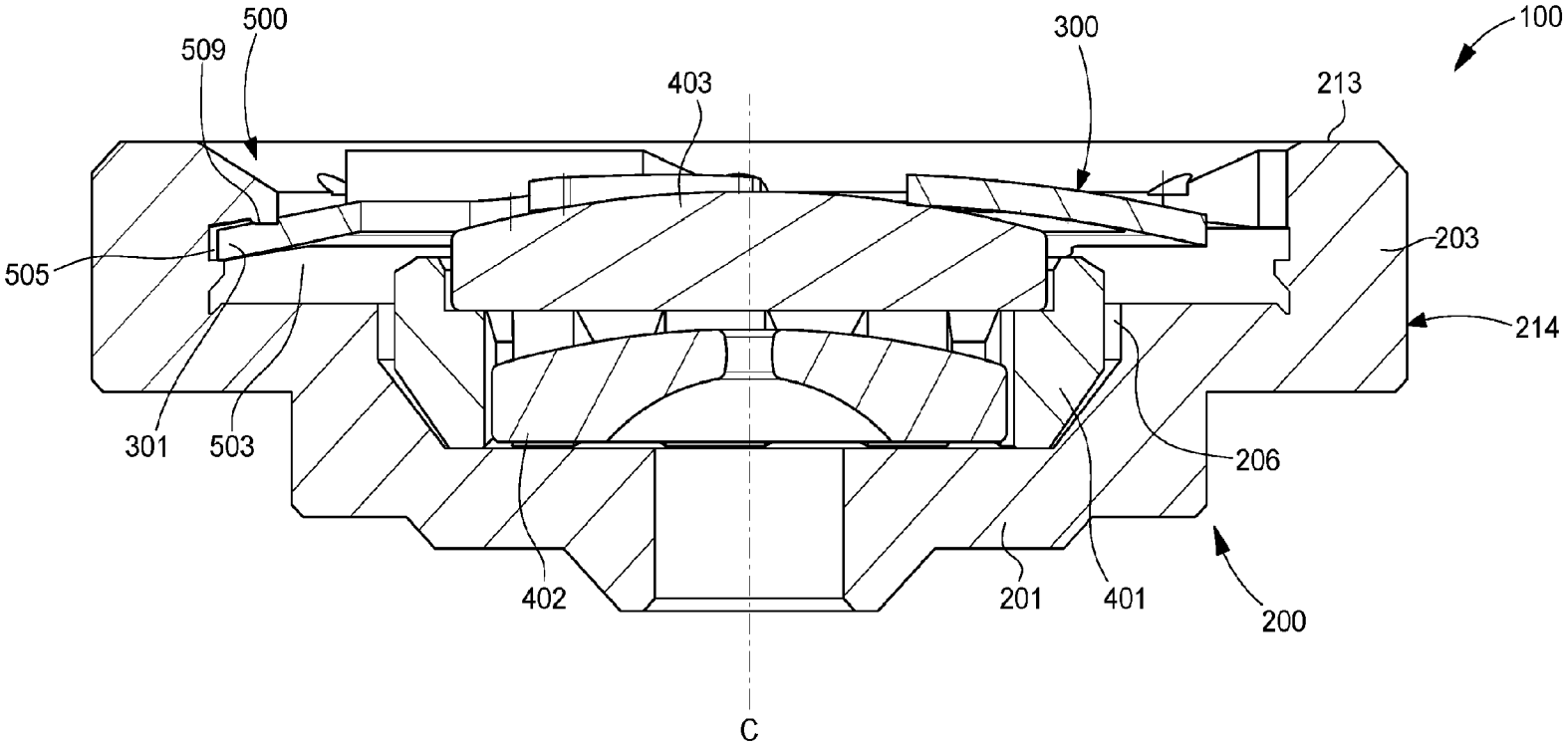
FIGS. 3 and 4 represent schematic views of a shock absorber system for a timepiece according to the invention when it is disassembled and assembled.
Figure 4:
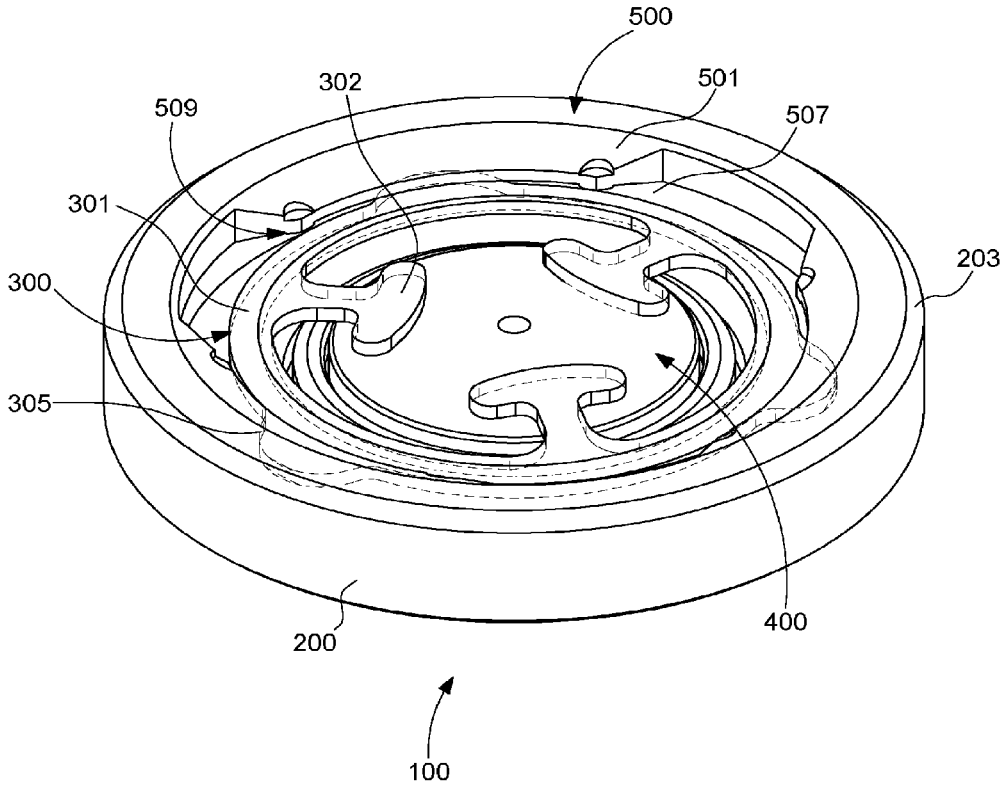

FIGS. 3 and 4 represent a shock absorber bearing or device 100 or anti-shock system according to a first embodiment. This shock absorber device or anti-shock system 100 is mounted in a base element of a timepiece movement. In particular, the main plate or the bars of the movement are the base element in which the anti-shock system 100 according to the invention is placed. This anti-shock system 100 includes a support 200. Support 200 takes the form of a cup 201 provided with a hole 202 surmounted by a peripheral rim 203 delimited, opposite said cup, by an upper surface 213. This peripheral rim 203 also has an outer wall 214 and an inner wall 215. Rim 203 and base cup 201 define a housing 206, into which a pivot module 400 is inserted. Rim 203 and base cup 201 could be in one-piece or separate components. A conventional pivot module 400 includes a setting 401, i.e. a part having a central circular orifice, an outer wall and an inner wall. A jewel hole 402, whose diameter corresponds to that of the central orifice, is inserted into the central orifice. The inner wall includes a shoulder enabling an endstone 403 to be secured. Pivot module 400 is then placed inside housing 206 of support 200 and cooperates with a pivot shank of an arbor.

Shockproof system 100 further includes elastic means 300 which are arranged to cooperate with pivot module 400. This allows shocks to be absorbed and pivot module 400 to be returned to its rest position when the stresses exerted following shocks die down. Elastic means 300 are fixed to support 200. Preferably, elastic means 300 are also placed on pivot module 400. Shockproof system 100 is then inserted into an orifice in the main plate or in one of the bars of the movement.

Elastic means 300 take, for example, the form of a spring ring 301. This spring ring 301 is of the flat type, i.e. it is formed of a strip or band, i.e. having greater width than thickness. The strip or band forming spring ring 301 is metallic and circular extending along a central axis (C).

Figure 5:
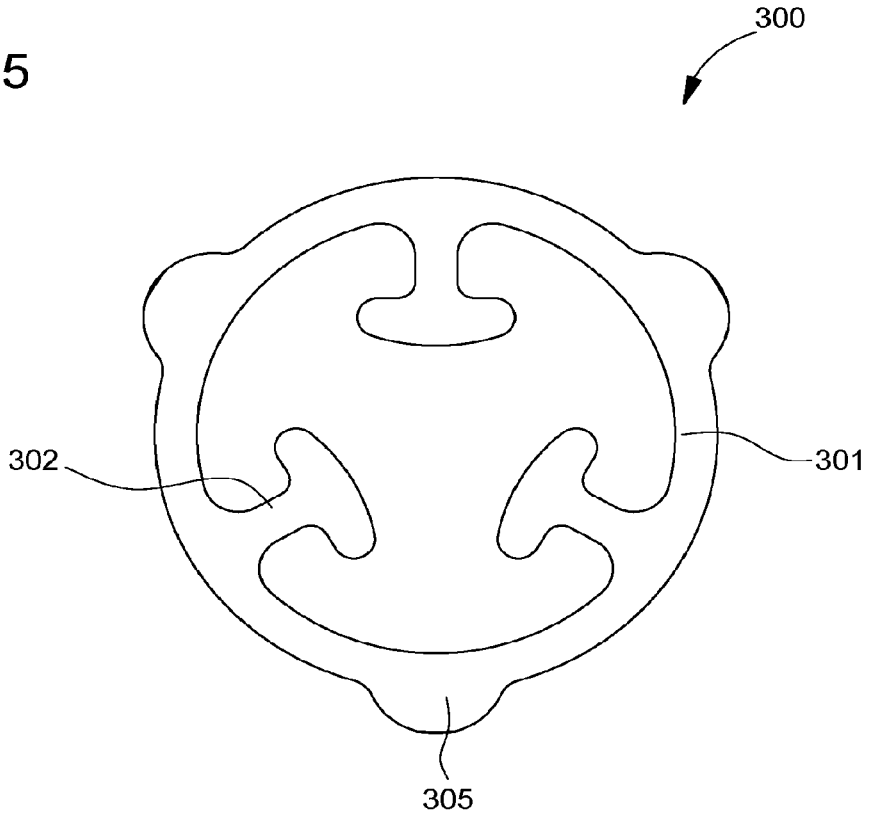
FIGS. 5 and 6 represent different solutions for the elastic means of the timepiece shock absorber system according to the invention.

In a first embodiment of this spring ring 301 seen in FIG. 5, elastic means 300 take the form of a circular spring ring 301 which includes arms 302 extending towards the axial centre of said spring ring 301. These arms 302 are diametrically opposite and are used to press said pivot module 400 into housing 206 of support 200. Spring ring 301 could include two or preferably three arms.

Figure 6:
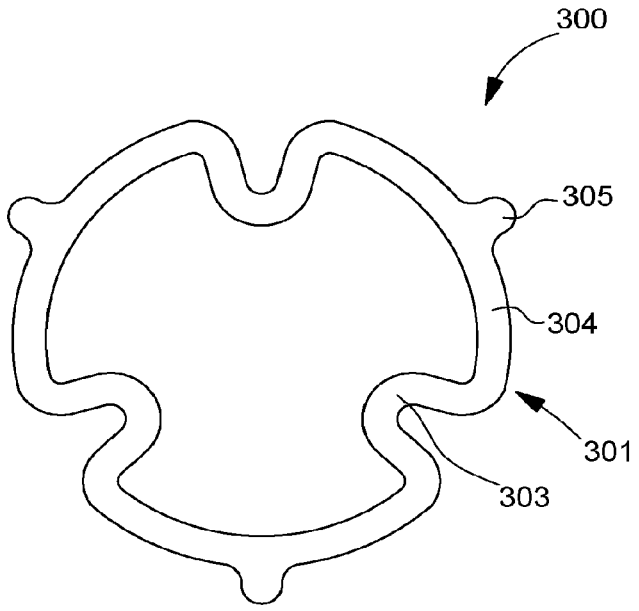

In a second embodiment of this spring ring 301 seen in FIG. 6, spring ring 301 includes inner radial extensions 303 arranged between annular parts 304. These inner radial extensions 303 consist of the band forming ring 301 which is bent towards the interior of ring 301. These inner radial extensions 303 are preferably regularly distributed over the periphery of flat ring 301 so that spring ring 301 can act homogeneously, as seen in FIG. 5. It is thus understood that spring ring 301 may be oriented in any manner with respect to support 200. Spring ring 301 could include two or preferably three radial extensions.

To mount and fasten elastic means 300 to support 200, a bayonet system 500 is used. Such a bayonet system includes a peripheral shoulder 501 extending from rim 203 towards the centre of support 200. This shoulder 501 forms, with support 200 and the rim, a retaining region 503. This retaining region 503 may also include a peripheral groove 505 so that elastic means 300 can be inserted therein. To mount the elastic means, shoulder 501 includes notches 507 such that the shoulder is divided into portions.

Advantageously, spring ring 301 has catches 305 extending away from the axial centre of said spring ring 301. These catches 305 are arranged to retain said spring ring 301. Indeed, the dimensions of spring ring 301 and of shoulder 501 are calculated such that catches 305 can be inserted into notches 507 of shoulder 501. The number of notches will preferably be identical to the number of catches. This number will preferably be three. The insertion of the catches into the notches of the shoulder allows said spring ring to be inserted into the retaining region. The spring ring then simply has to be rotated for the catches to be placed under shoulder 501. Indeed, the mounting of the spring is subsequent to the step intended to place pivot module 400 inside its housing 206 so that the mounting of the spring ring causes the appearance of a stress applied on said spring ring. This stress is due to the pivot module which tends to push the spring ring towards the exterior of the housing, whereas the catches of said spring ring are in abutment on the shoulder, thereby retaining said spring ring. Of course, it would be possible to have only one notch in the shoulder but to have a spring ring with two or three catches.

The presence of catches 305 makes it possible to limit the stress exerted on said spring ring 301 by the shoulder so that the stress is confined to catches 305. Consequently, catches 305 are passive regions, i.e. with no effect on the behaviour of spring ring 301. Therefore, the initial behaviour of spring ring 301 is not modified by the assembly thereof to support 200.

Artfully, according to the invention, the portions of shoulder 501 are devised to have a beak 509 at each end. These beaks located at each end of a shoulder portion have the function of locking the spring ring. Indeed, in operating mode, the shock absorber system works such that the spring is subjected to more or less stress. However, it may happen that the spring is no longer under stress so that displacement of the spring ring is possible. This displacement may be a rotational motion of the spring ring on itself. Consequently, if the rotation is too great, there is a risk of the catches finishing opposite the notches and thus of the spring ring becoming disassembled. Thus, the presence of the beaks advantageously resolves this problem by acting as a rotation limiter. During a rotation of the spring ring on itself in the event of low stress, the beaks act as a stop to halt the rotation. It is not possible for the spring ring catches to end up opposite the notches and the spring ring cannot therefore become disassembled by itself.

It is possible to envisage making support 200 and the element of the movement in which shock absorber bearing 100 is placed as a single part, support 200 and the element of the movement are thus one-piece. It is thus understood that the base element has a housing arranged to form the pierced bottom of a hole and forming housing 206 inside which pivot module 400 is placed. It is also understood that this second variant may co-exist with the first variant.

Indeed, since a bar or a main plate may be of any shape, the arrangement of a mounting region ensures that the fastening means can be installed and therefore that pivot module 400 can be held in the housing.

It will be clear that various alterations and/or improvements and/or combinations evident to those skilled in the art may be made to the various embodiments of the invention set out above without departing from the scope of the invention defined by the annexed claims.

Indeed, it is possible for pivot module 400 to be formed of a single jewel or for the jewel hole and endstone to be integral with each other. It is understood that the jewel hole and the endstone may be driven one inside the other or be in a single piece. These possibilities allow the number of parts of the shock absorber bearing to be limited.

What is claimed is:

1. A shock absorber device for an arbor of a timepiece element comprising:

a support including a base cup surmounted by a peripheral rim delimited, opposite said cup, by an upper surface and including an outer wall, said cup and the rim defining together a housing;

at least one pivot module extending along an axis, said at least one pivot module being arranged inside said housing and able to cooperate with said arbor;

fastening means including a peripheral shoulder extending from the rim towards the axial center of the cup; and elastic means being arranged between the pivot module and the shoulder to exert a stress on the pivot module, wherein the elastic means include a spring ring provided with at least one radial extension extending towards the center of said ring and with at least two catches extending in an opposite direction, said shoulder including at least one notch to allow a mounting of said spring ring based on a bayonet system, and wherein the shoulder includes, on either side of said at least one notch, a beak oriented towards the base cup allowing said elastic means to be locked in rotation.

2. The shock absorber device according to claim 1, wherein the shoulder includes three notches, said spring ring including three catches.

3. The shock absorber device according to claim 1, wherein said elastic means include a spring ring including at least two arms extending towards the axial center of said spring ring to press said pivot module into the housing of the support.

4. The shock absorber device according to claim 3, wherein the at least two arms are diametrically opposite.

5. The shock absorber device according to claim 3, characterized in that the spring ring includes three angularly distributed arms.

6. The shock absorber device according to claim 1, wherein said elastic means include a spring ring including inner radial extensions arranged between annular portions, said inner radial extensions being formed by a band forming the spring ring bent towards the interior of the spring ring.

7. The shock absorber device according to claim 6, wherein said inner radial extensions are regularly distributed.

8. The shock absorber device according to claim 6, wherein the spring ring includes three inner radial extensions.

* * * * *